US008156991B2

(12) United States Patent
Cheng et al.

(10) Patent No.: US 8,156,991 B2
(45) Date of Patent: Apr. 17, 2012

(54) CORD LOCK OF WINDOW COVERINGS

(75) Inventors: Ju-Sheng Cheng, Taichung (TW); Yu-Che Wen, Taoyuan County (TW)

(73) Assignee: Nien Made Enterprises Co., Ltd., Taichung (TW)

( * ) Notice: Subject to any disclaimer, the term of this patent is extended or adjusted under 35 U.S.C. 154(b) by 131 days.

(21) Appl. No.: 12/382,574

(22) Filed: Mar. 19, 2009

(65) Prior Publication Data

US 2010/0236731 A1 Sep. 23, 2010

(51) Int. Cl.
*E06B 9/324* (2006.01)

(52) U.S. Cl. ..... 160/178.2; 160/168.1 R; 160/173 R

(58) Field of Classification Search ..... 160/178.2, 160/168.1 R, 173 R; 24/115 L, 136 R, 453, 24/457, 458, 297
See application file for complete search history.

(56) References Cited

U.S. PATENT DOCUMENTS

| | | | | | |
|---|---|---|---|---|---|
| 2,449,583 | A * | 9/1948 | Burns | 160/173 R |
| 3,561,068 | A * | 2/1971 | Croxson | 4/458 |
| 4,180,118 | A * | 12/1979 | Vecchiarelli | 160/178.2 |
| 4,356,599 | A * | 11/1982 | Larson et al. | 24/16 PB |
| 4,463,791 | A * | 8/1984 | McClure | 160/178.2 |
| 4,488,588 | A * | 12/1984 | McClure | 160/178.2 |
| 4,531,563 | A * | 7/1985 | Nilsson | 160/168.1 R |
| 4,646,808 | A * | 3/1987 | Anderson | 160/178.2 |
| 4,945,970 | A * | 8/1990 | Marocco | 160/178.2 |
| 5,662,375 | A * | 9/1997 | Adams et al. | 296/214 |
| 6,050,321 | A * | 4/2000 | Koks et al. | 160/178.2 |
| 7,117,920 | B2 * | 10/2006 | Dekker et al. | 160/178.2 |
| 7,159,638 | B2 * | 1/2007 | Hsu | 160/178.2 |
| 7,261,138 | B2 * | 8/2007 | Judkins et al. | 160/178.2 |
| 7,597,131 | B2 * | 10/2009 | Nien et al. | 160/178.2 |
| 2003/0201076 | A1 * | 10/2003 | Nien | 160/168.1 R |
| 2006/0249263 | A1 * | 11/2006 | Liang | 160/168.1 R |
| 2007/0044925 | A1 * | 3/2007 | Huang | 160/178.2 |
| 2007/0102125 | A1 * | 5/2007 | Nien et al. | 160/178.2 |
| 2009/0126168 | A1 * | 5/2009 | Kobe et al. | 24/458 |
| 2010/0199468 | A1 * | 8/2010 | Matsui et al. | 24/457 |
| 2010/0275417 | A1 * | 11/2010 | Yang | 24/115 L |

OTHER PUBLICATIONS

"Engaged" The American Heritage® Dictionary of the English Language, Fourth Edition copyright © 2000 by Houghton Mifflin Company. Updated in 2009. Published by Houghton Mifflin Company. All rights reserved. http://www.thefreedictionary.com/engaged.*

* cited by examiner

*Primary Examiner* — Katherine w Mitchell
*Assistant Examiner* — Johnnie A Shablack
(74) *Attorney, Agent, or Firm* — Bacon & Thomas, PLLC

(57) ABSTRACT

A cord lock of the window blinds or shade includes a box having a chamber therein, an engaging block on an outer side, a first opening for a cord exiting the box, a second opening for the cord entering the box, a fixed locking portion on the outer side, and a flexible locking portion opposite the fixed locking portion; and a movable driving wheel, which is received in the chamber of the box, to be moved between a lock position, in which the movable driving wheel is moved toward the engaging block to clip the cord therebetween, and a release position, in which the movable driving wheel is moved away from the engaging block to release the cord. The fixed locking portion provides the box fixing to the top rail with a strong strength, and the flexible locking portion provides an easy way to mount the box on the top rail.

15 Claims, 12 Drawing Sheets

CORD LOCK OF WINDOW COVERINGS

BACKGROUND OF THE INVENTION

1. Field of the Invention

The present invention relates to a window-covering product and more particularly, to a cord lock for window blinds or shades.

2. Description of the Related Art

Traditionally, a conventional cord lock for window blinds or shade includes a box mounted on the top rail of the window blinds or shade, a fixed pulley provided in the box, and a movable driving wheel provided in the box to lock or release a cord such that operation of the cord may control up and down movement of the blinds and also stop movement of the blinds (or a shade).

The conventional box, however, is fixed to a recess on the top rail such that an L-shaped iron plate and screws are incorporated to fix the box on the top rail. This arrangement is complex and makes it difficult for consumers to assemble and disassemble the device. To fix the above drawback, U.S. Pat. Nos. 4,945,970 and 7,117,920 disclose a box that is provided with two retractable locking blocks on opposite sides for engagement with the recess. The locking blocks are pressed inwards to place the box onto the top rail, and while the box is completely placed in the recess of the top rail, the locking blocks will jump out automatically to secure the box to the top rail. However, it is very hard for the removable box, the fixed pulley, and the movable driving wheel to resist the force that the user exerts on the cord and the weight of the cord and the window blinds or shade. As a result, the box may become loosened over time, or even become disengaged with the recess.

Additionally, when the cord is pulled downward or swung to the right or left, it moves the movable driving wheel between a release position, in which the movable driving wheel keeps a distance from the fixed pulley, and a lock position, in which the movable driving wheel touches the fixed pulley. In the release position, the blinds (or the shade) are free to move, and in the lock position, the blinds (or the shade) are secured.

However, while in the lock position, the movable driving wheel only has one point touching the fixed pulley such that it provides insufficient force to secure the cord. As a result, the cord may slip or become loosened from the fixed wheel because of the weight of the blinds or the shade.

SUMMARY OF THE INVENTION

The primary objective of the present invention is to provide a cord lock for a window covering (window blinds or shade), which is easy to assemble and disassemble, and the cord lock is firmly mounted on the window covering.

The secondary objective of the present invention is to provide a cord lock for window blinds or shade, which can provide a firm cord lock while controlling the window covering.

To achieve these objectives of the present invention, a cord lock for a window covering of the present invention includes a box having a chamber therein, an engaging block on an outer side, a first opening for a cord exiting the box, a second opening for the cord entering the box, a fixed locking portion on the outer side, and a flexible locking portion opposite the fixed locking portion; and a movable driving wheel, which is received in the chamber of the box, to be moved between a lock position, in which the movable driving wheel is moved toward the engaging block to clip the cord therebetween, and a release position, in which the movable driving wheel is moved away from the engaging block to release the cord.

DETAILED DESCRIPTION OF THE INVENTION

Figure 1:
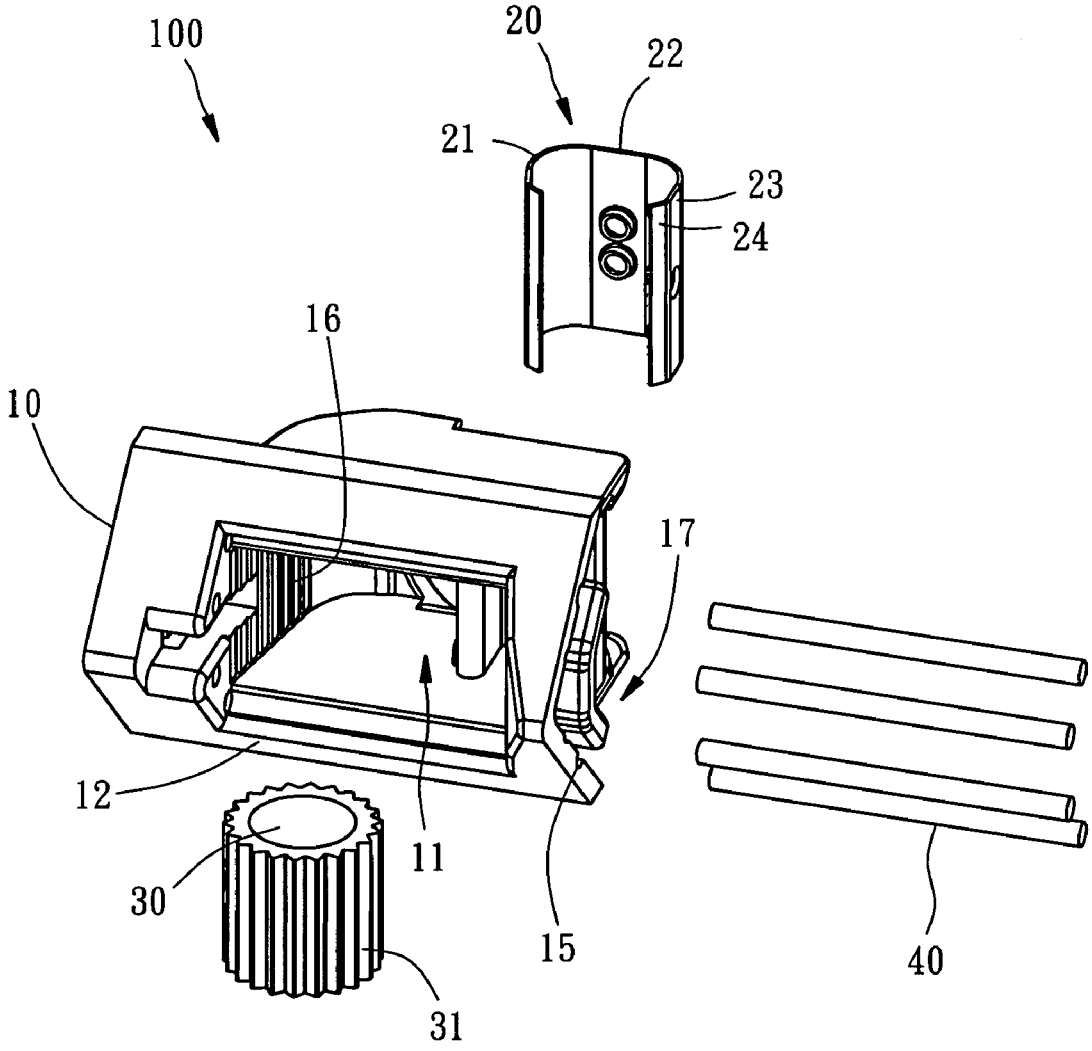
FIG. 1 is an exploded view of a first preferred embodiment of the present invention.

Referring to FIGS. 1 to 10, a cord lock 100 of a window covering (window blinds or shade) of the first preferred embodiment of the present invention includes a box 10, a wear-resisted member 20, a movable driving wheel 30, and a plurality of poles 40.

Figure 3:
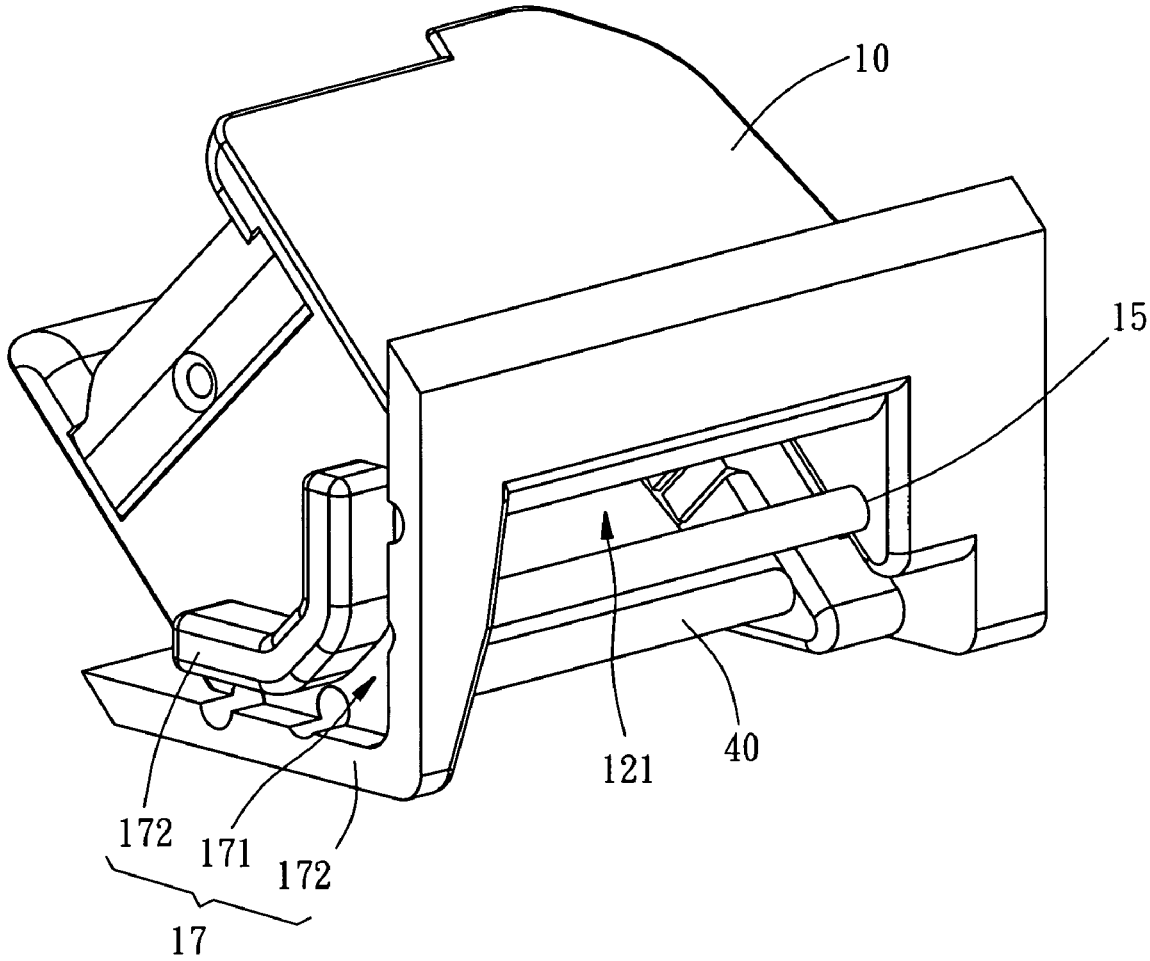
FIG. 3 is another perspective view of the first preferred embodiment of the present invention.
Figure 4:
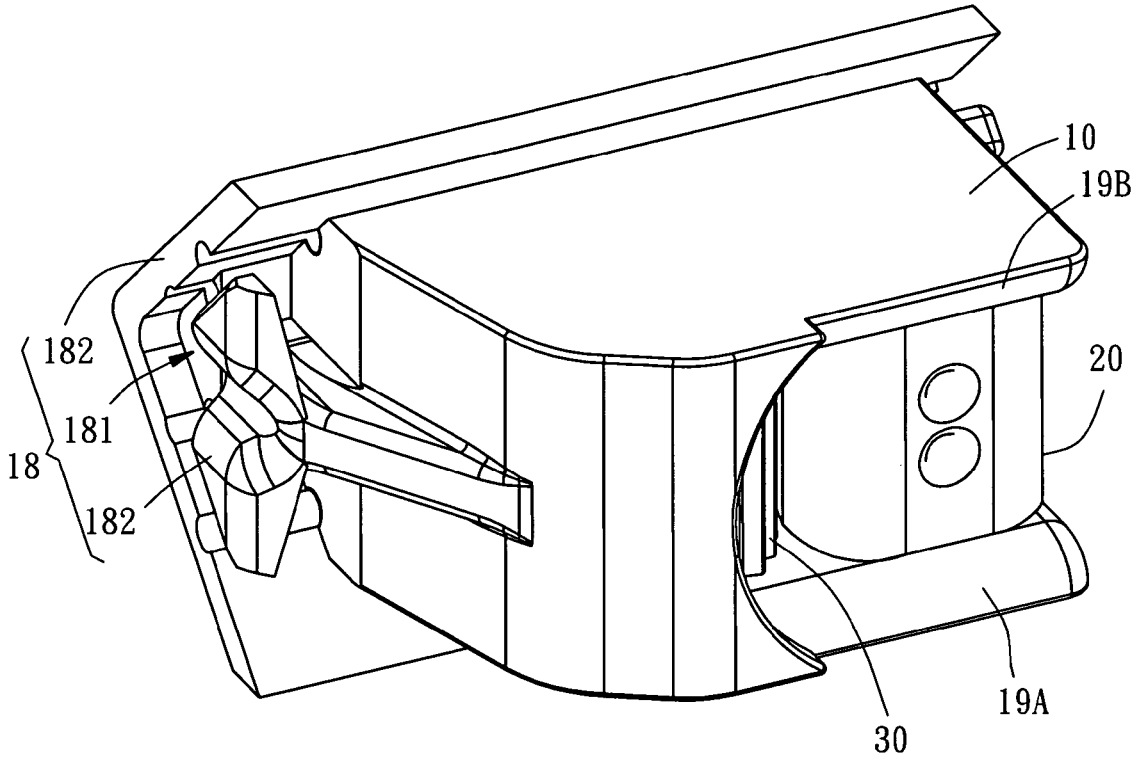
FIG. 4 is the third perspective view of first the preferred embodiment of the present invention.

The box 10 has a chamber 11 therein, a first opening 12 on a front side communicated with the chamber 11, and second opening 13 on a back side thereof communicated with the chamber 11. The box 10 further is provided with a stop device 14 (engaging block) on a sidewall of the second opening 13. The engaging block 14 has a convex portion 142 and two slots 141. The convex portion 142 has a curvature smaller than that of the movable driving wheel 30. The box 10 further has a first curved portion 19A and a second curved portion 19*b* on opposite sides of the engaging block 14 (as shown in FIG. 4) that may reduce a friction when a cord enters the box 10 via the opposite sides without touching the engaging block 14. The box 10 is provided with a plurality of through holes 15 on opposite sidewalls of the first opening 12, and a first toothed portion 16 on a sidewall of the chamber 11. The first toothed portion 16 is opposite the engaging block 14. The box 10 has a fixed locking portion 17 on an outer side with the engaging block 14. The fixed locking portion 17 includes two first fixed blocks 172 and a first slot 171 between the first fixed blocks 172. The first fixed blocks 172 and the first slot 171 are L-shaped (as shown in FIG. 3) in association with a recess 91 of a top rail 90. (The recess 91 is open at both a bottom and a lateral side of the top rail 90.) The box 10 has a flexible locking portion 18 on a side opposite the fixed locking portion 17. The flexible locking portion 18 has two second blocks 182, a second slot 181 between the second blocks 182, and a flexible block 183. The second slot 181 is a L-shaped slot.

One of the second blocks 182 is adjacent to the front side of the box 10 (The front side has the first opening 12 thereon.) the flexible block 183 is opposite the second slot 181 and distal to the front side of the box 10 than the second fixed block 182. (The front side has the first opening 12 thereon.) The flexible block 183 has a shape complementary to an inner space of the top rail 90. The flexible block 183 has a hollow portion that the flexible block 183 may be compressed by an external pressure and tends to eject out when the pressure is out (as shown in FIG. 4).

Figure 8:
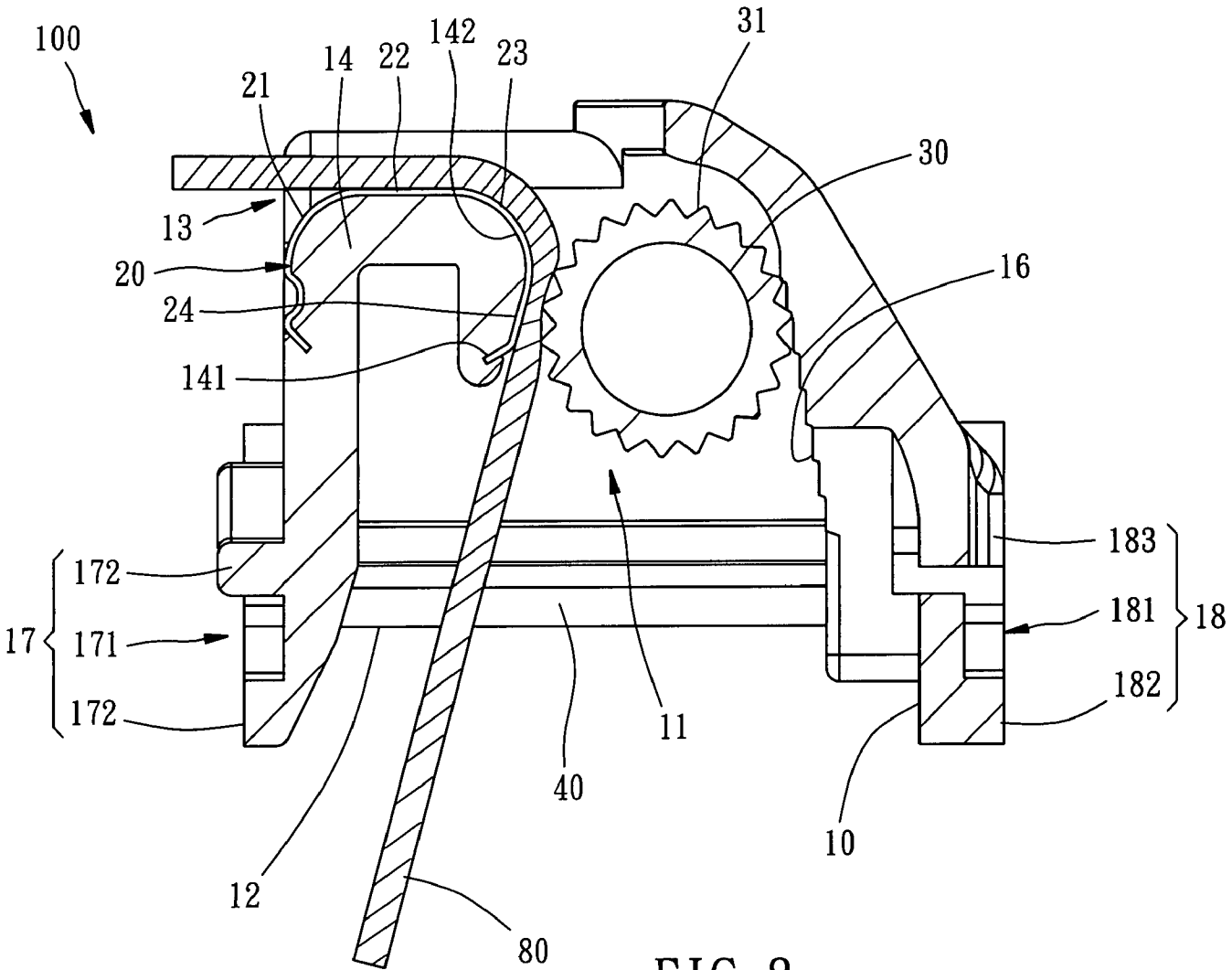
FIG. 8 and FIG. 9 are sectional views of the first preferred embodiment of the present invention, showing the actions of the cord lock.

The wear-resisted member 20 is a metal piece or a hard plastic piece having a high wear-resisting property. Opposite ends of the wear-resisted member 20 are engaged with the slots 141 of the box 10 that the wear-resisted member 20 covers the engaging block 14 to allow the cord to lean thereon. A surface of the wear-resisted member 20 where the cord leans includes a first curved surface 21, a flat surface 22, a second curved surface 23, and a slope 24 (as shown in FIG. 8). The first curved surface 21 and the second curved surface 23 may reduce the friction when the cord moves on the wear-resisted member 20. The first toothed portion 16 of the box 10 co-acts with the slope 24 of the wear-resisted member 20 to form a self-lock angle. The self-lock angle works according to a wedge principle for a self-lock action. An angle of the self-lock angle is between 32 degrees and 5 degrees.

The movable driving wheel 30, which is made of a wear-resisting material, has a second toothed portion 31 on an outer side. The movable driving wheel 30 is received in the chamber 11 of the box 10 with the second toothed portion 31 engaged with the first toothed portion 16 of the box 10 (as shown in FIG. 2) that the movable driving wheel 30 moves along the first toothed portion 16 between a lock position and a release position.

Figure 2:
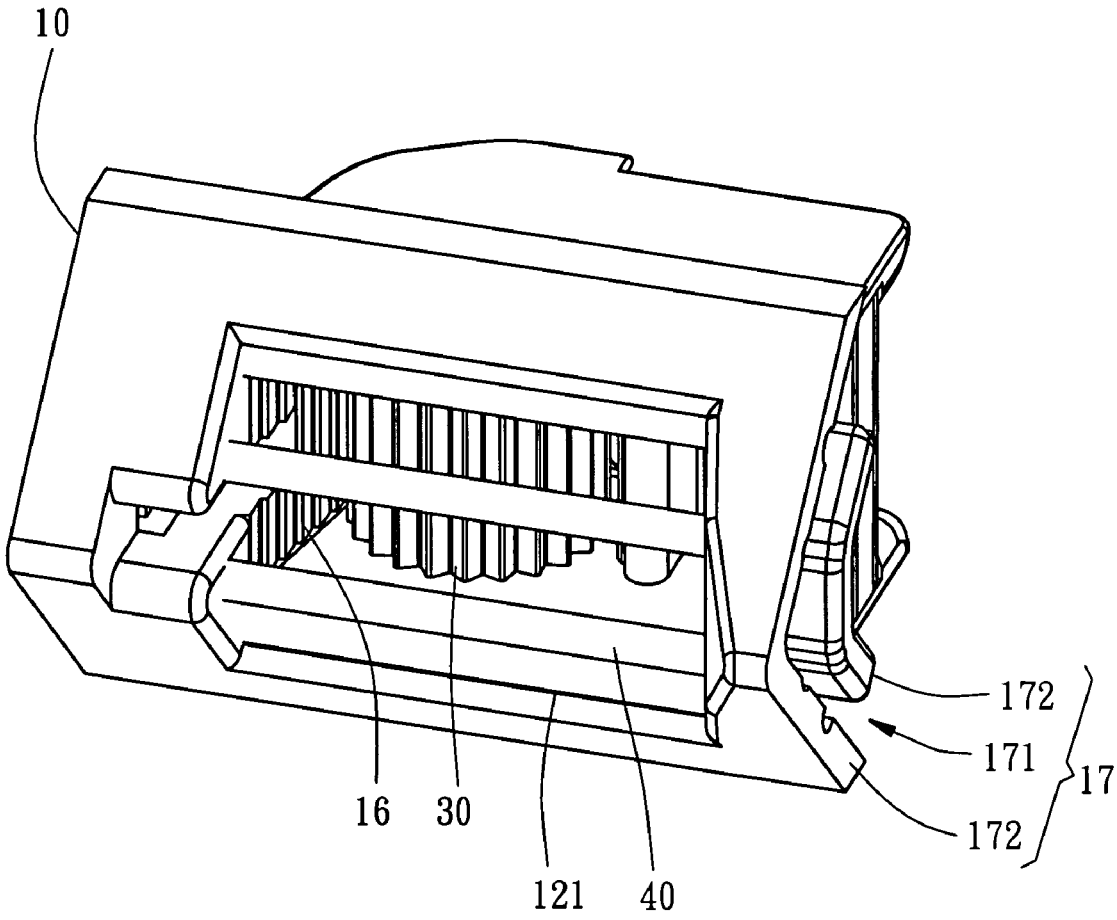
FIG. 2 is a perspective view of the first preferred embodiment of the present invention.

The poles 40, which are made of a wear-resisting material, are inserted into the through holes 15 with a constant interval that the poles 40 divides the first opening 12 into several sub-openings 121 and restricts the movable driving wheel 30 in the chamber 11 of the box 10 (as shown in FIG. 2).

Above are the elements of the cord lock 100 of the first embodiment of the present invention, and we will describe the way of assembling the elements and the function of the present invention as follows.

Figure 5:
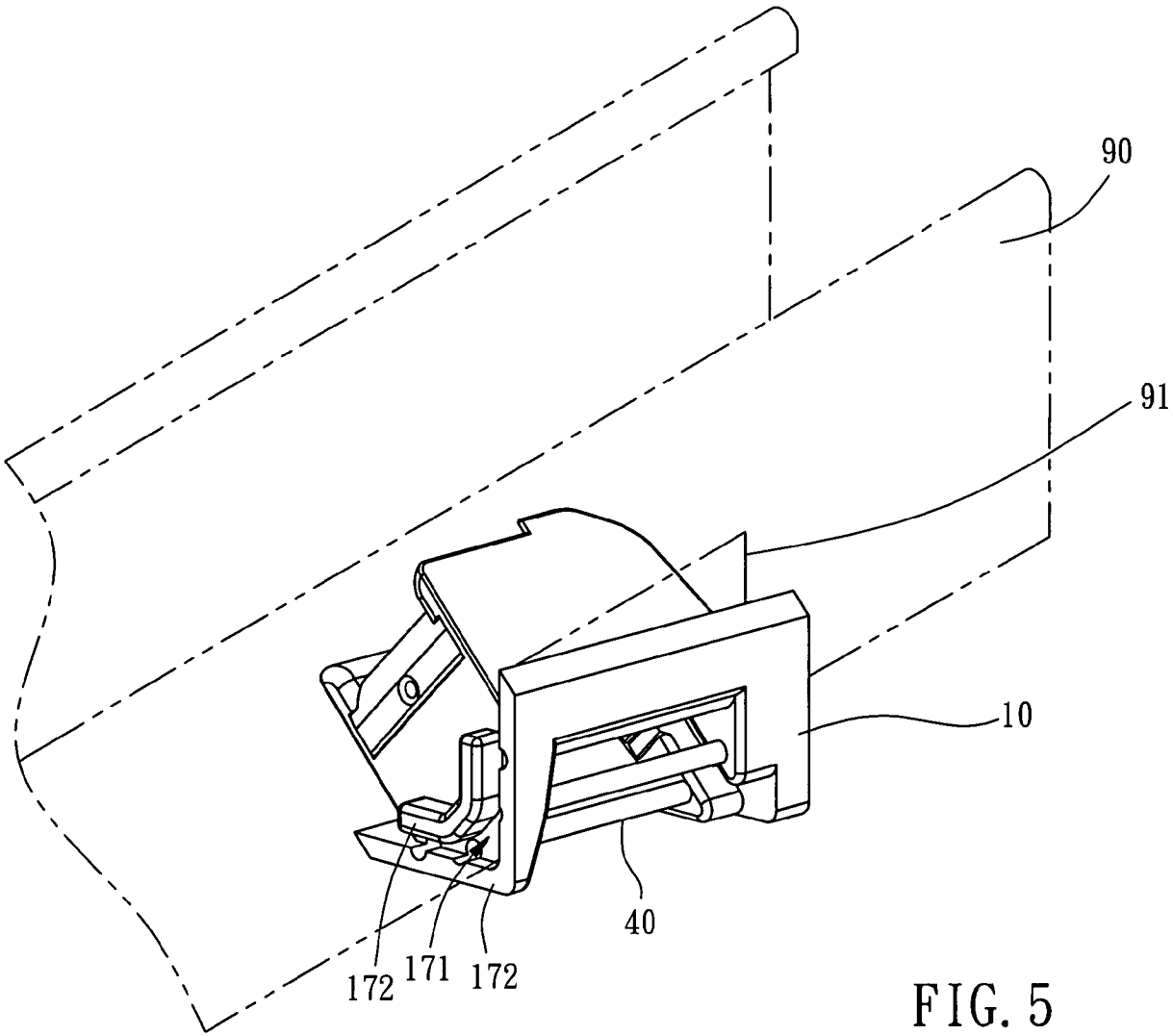
FIG. 5 is a perspective view of the first preferred embodiment of the present invention, showing the cord lock mounted on the top rail.

First, the assembled cord lock 100 is mounted on the recess 91 of the top rail 90, and the assembling way includes: putting the box 10 in a tilting position into the recess 91 with the first slot 171 engaged with a sidewall of the recess 91 that the first fixed blocks 172 are engaged with an inner side and an outer side of the sidewall of the recess 91 (as shown in FIG. 5), and then pushing the box 10 to have the other side thereof entering the recess 91 that the flexible block 183 is compressed by the sidewall of the recess 91 first to let the flexible block 183 entering the recess 91, and then the flexible block 183 will eject out to be stopped by the sidewall when the second slot 181 is engaged with the sidewall. Because the second fixed block 182 is complementary to the space inside the top rail 90, it could help the box 10 fixed in the recess 91 of the top rail 90 firmly. With the fixed locking portion 17 and the engaging block 14 on the same side, the fixed locking portion 17 has a greater strength to sustain the force of the cord.

Figure 6:
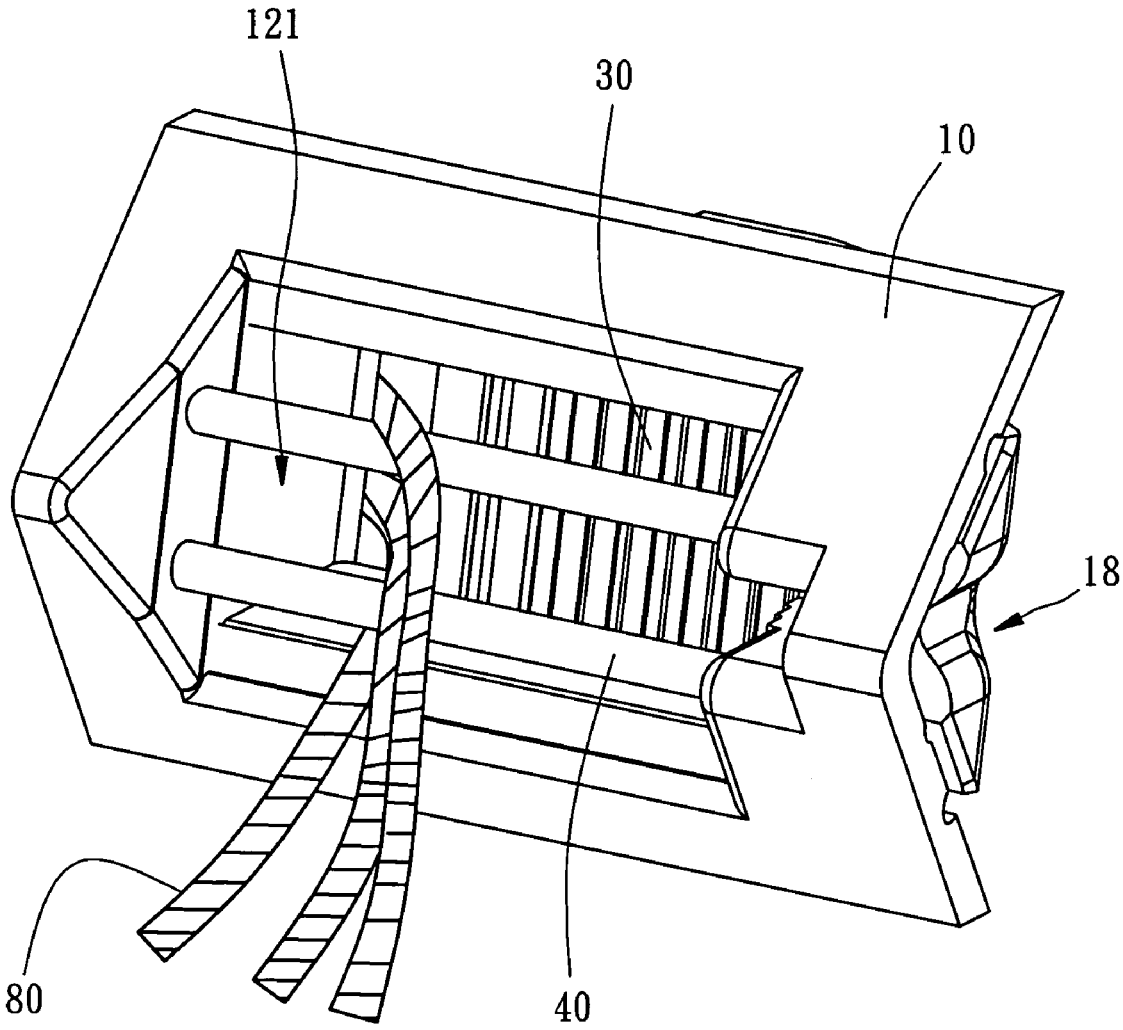
FIG. 6 is the fourth perspective view of the first preferred embodiment of the present invention before installation.

Next, inserting a cord 80 connecting a window covering (window blinds or shade) into the box 10 via the second opening 13 and through a space between the wear-resisted device 20 and the movable driving wheel 30, and then going out of the box 10 via the first opening 12 (as shown in FIG. 6) for manipulation.

Figure 7:
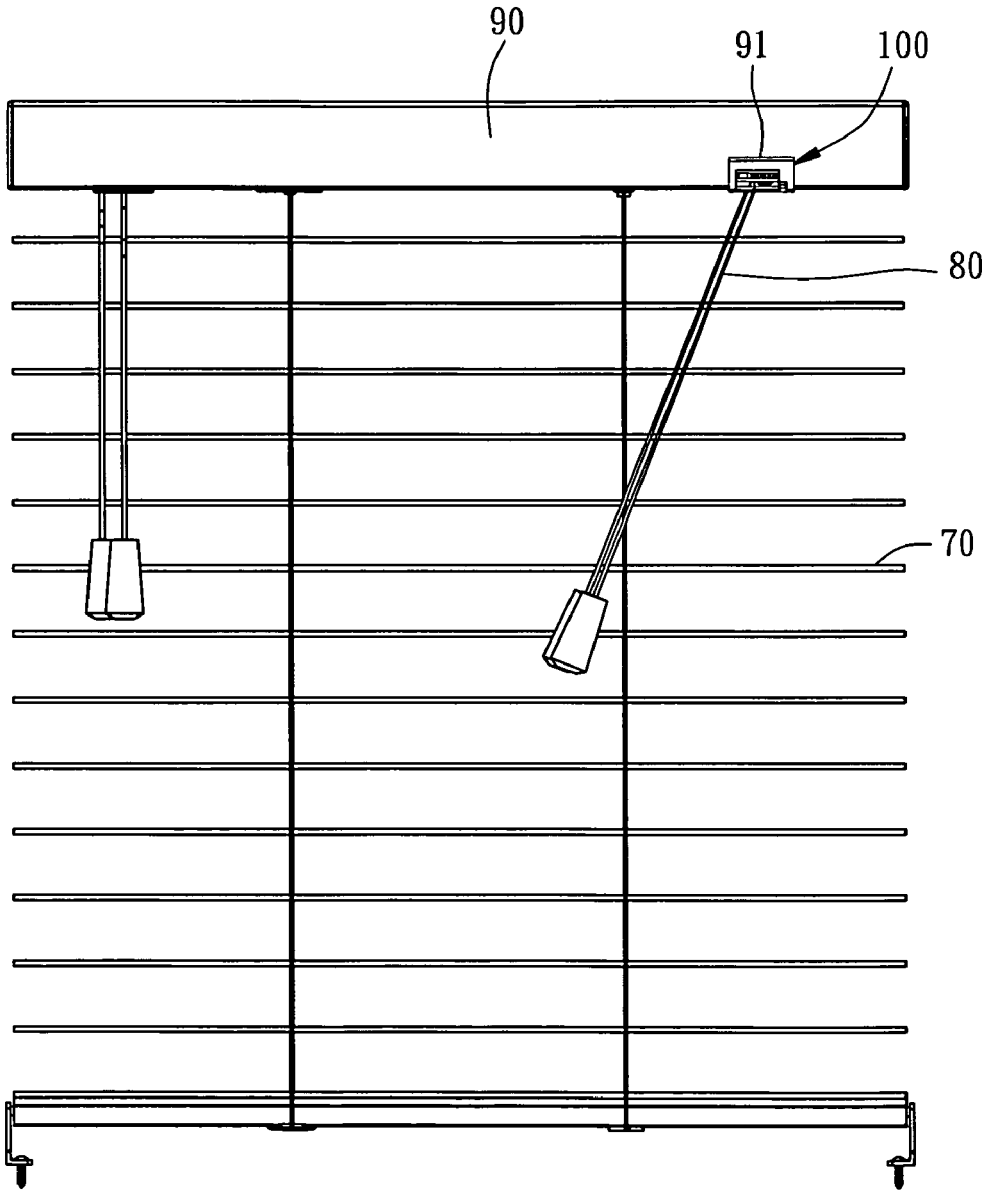
FIG. 7 is a perspective view of a window blinds or shade, on which the cord lock of the present invention is mounted.
Figure 9:
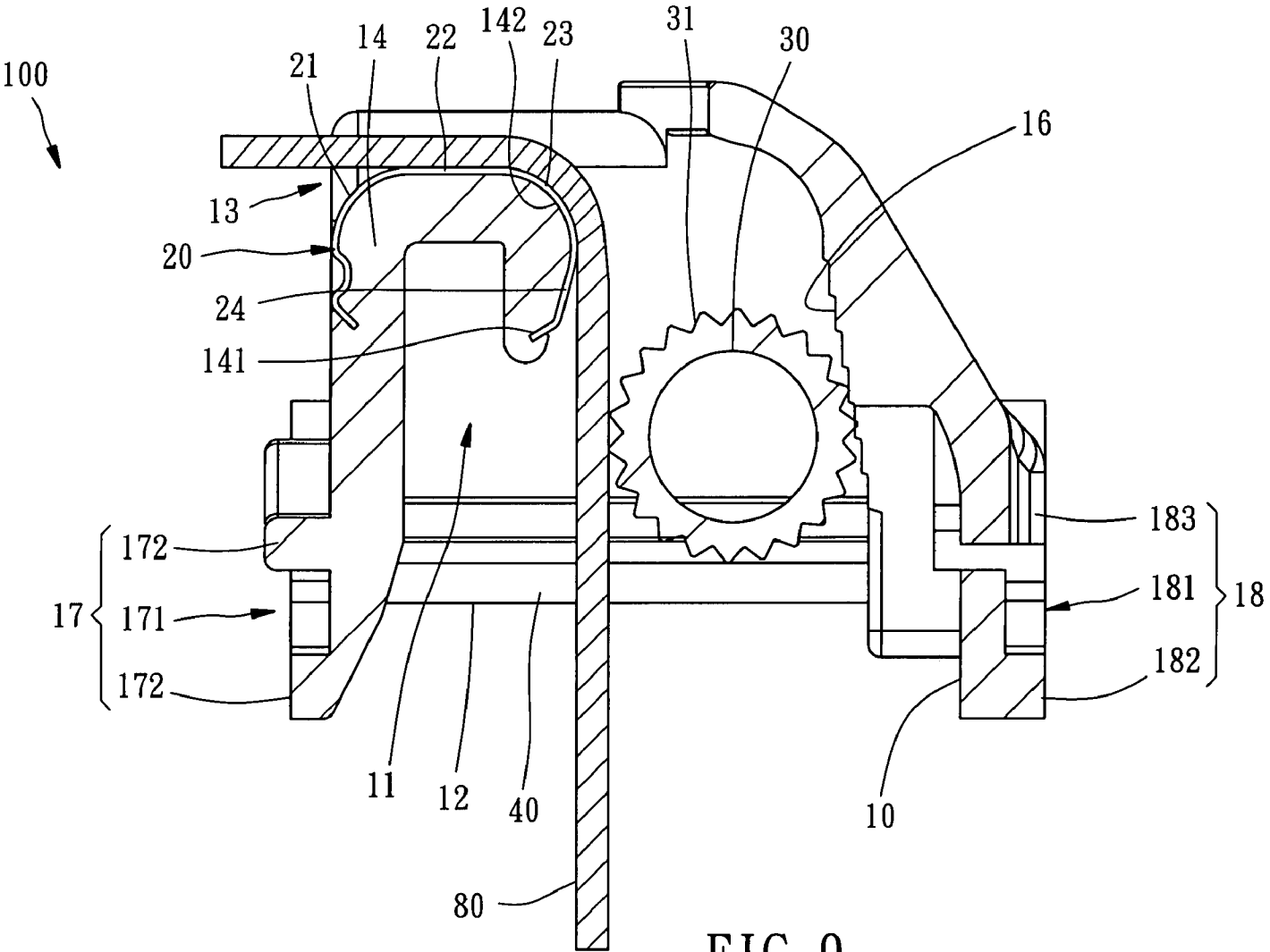
Figure 10:
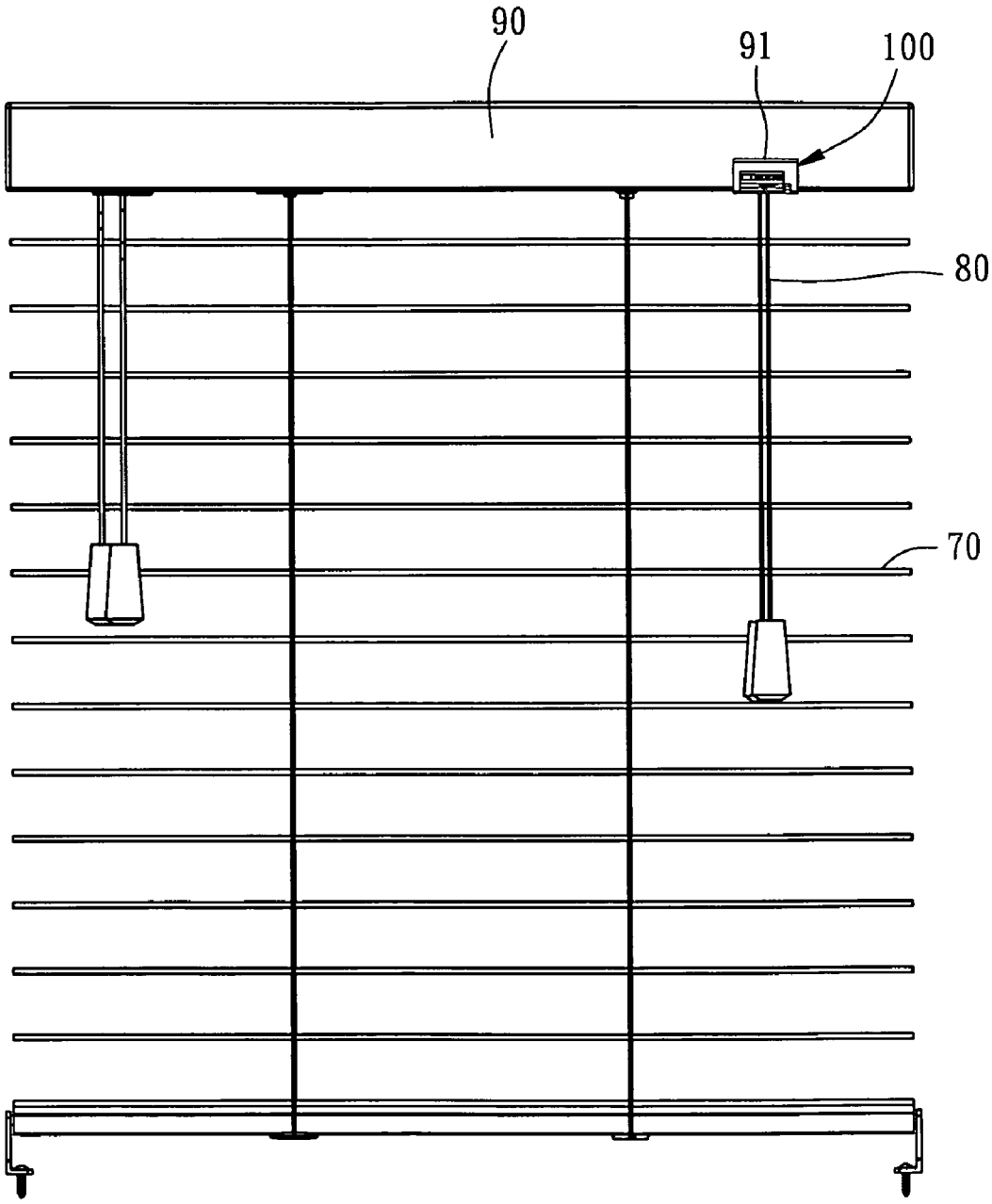
FIG. 10 is a perspective view of a window blinds or shade, on which the cord lock of the present invention is mounted.

To move the window covering up and down, one may hold the cord 80 left out of the box 10 to the left (as shown in FIG. 7 and FIG. 8) to move the cord 80 will toward the wear-resisted device 20 and away from the movable driving wheel 30 that the movable driving wheel 30 will roll downward because of the weight of itself to the release position (as shown in FIG. 9). In the release position, the movable driving wheel 30 moves off the wear-resisted device 20 that the cord 80 is no longer locked by the movable driving wheel 30, and the cord 80 is free to pull or release to move the window covering 70.

To fix the window covering 70, one may hold the cord 80 straight (as shown in FIG. 9) and release the cord 80 that the cord 80 moves the movable driving wheel 30 upward to the lock position (as shown in FIG. 8), in which the slope 24 of the wear-resisted device 20 and the movable driving wheel 30 clip the cord 80 therebetween to secure the cords 80. Because both of the wear-resisted device 20 and the movable driving wheel 30 have hard smooth surfaces to touch each other, it could reduce the wear of the cord 80 to prolong the life of the cord 80.

The present invention provides the box 10 with the fixed locking portion 17 and the flexible locking portion 18 to provide a fixed side for fixed engagement and a flexible side for flexible engagement that would provide an easier way to assemble the box 10 on the top rail 90. (The fixed locking portions are engaged with the top rail first, and then the flexible locking portion is pushed into the recess to complete the assembling work.) Besides, the fixed locking portion 17 has a greater hardness and is on the same side with the wear-resisted device 20 that could sustain more pressure of the cord 80 exerting on the box 10 and help the box 10 fixed on the top rail 90 firmly.

Besides, the wear-resisted device 20 of the present invention is a plate-like member, and the curvature of the convex portion 42 of the engaging block 14 is smaller than that of the movable driving wheel 30 (which means the driving device has a curvature diameter greater than that of the movable driving wheel) that the slope 24 of the wear-resisted device 20 may provide a greater-area support to the cord 80 when the cord 80 is clipped. To compare with the conventional device that the cord is clipped by point, the present invention provides a greater clipping force to prevent the cord from loosing.

Figure 11:
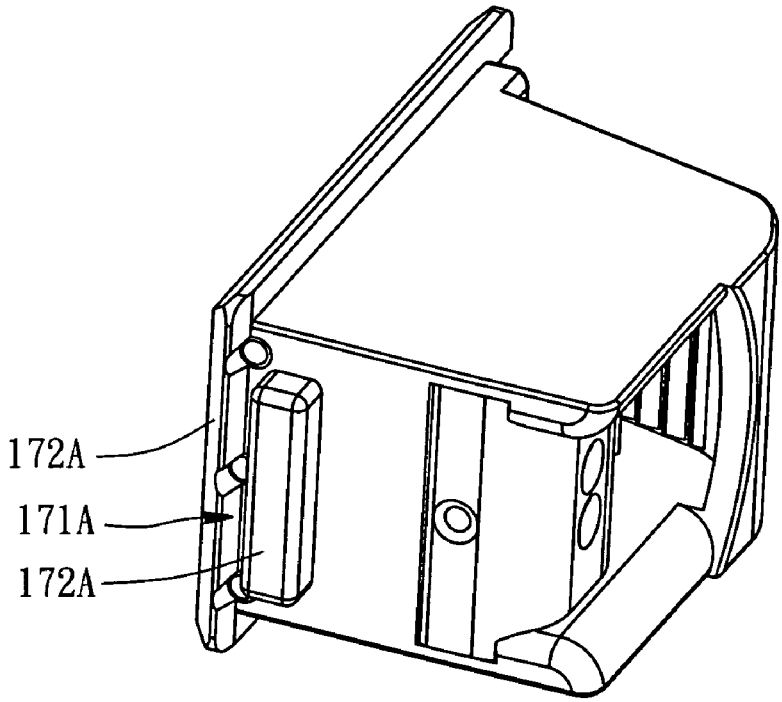
FIG. 11 is a perspective view of a second preferred embodiment of the present invention.
Figure 12:
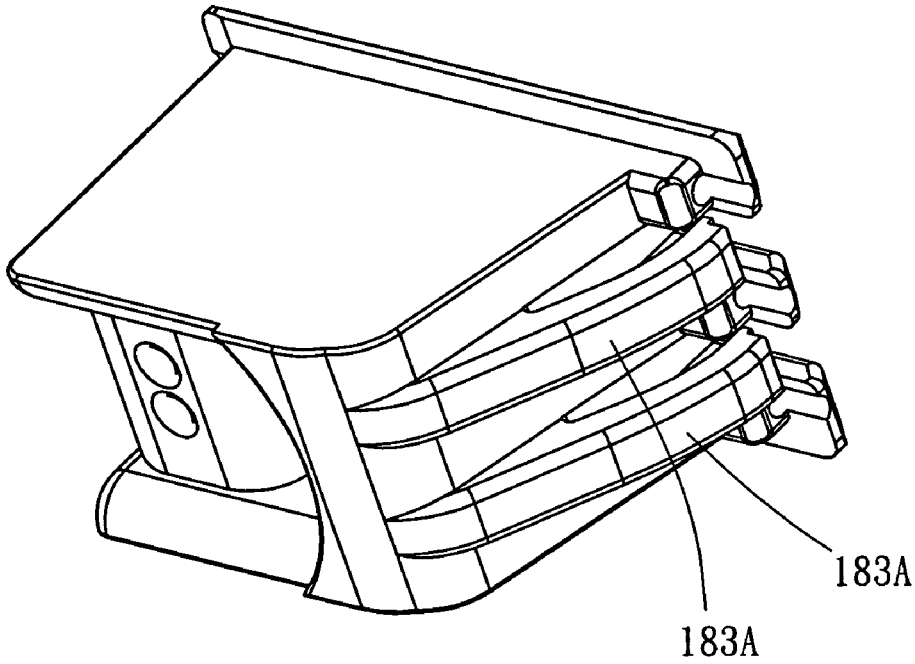
FIG. 12 is another perspective view of the second preferred embodiment of the present invention.
Figure 13:
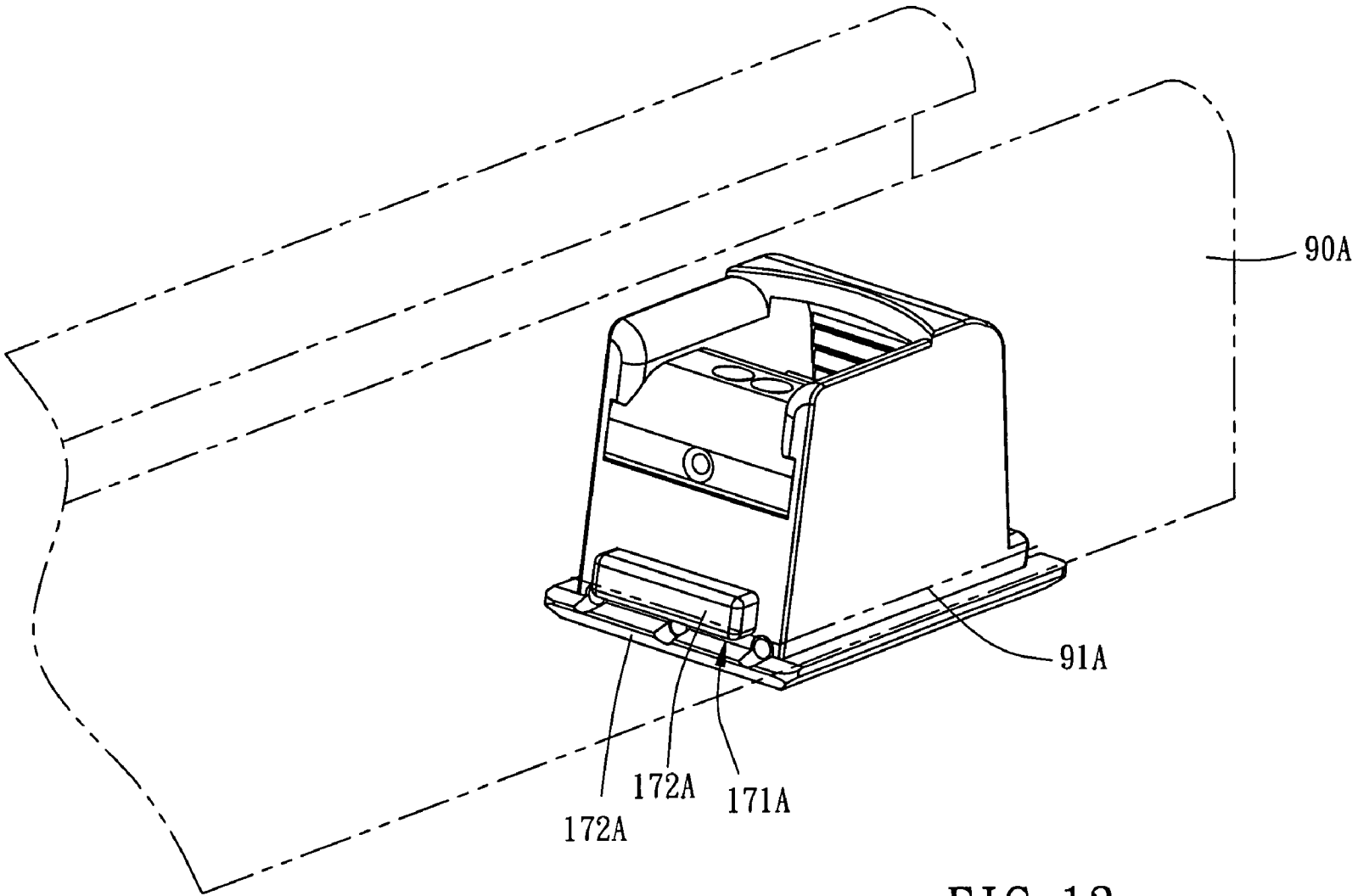
FIG. 13 is a perspective view of the second preferred embodiment of the present invention, showing the cord lock mounted on the top rail.

As shown in FIGS. 11 to FIG. 13, a cord lock of the second preferred embodiment of the present invention, which is similar to the first preferred embodiment, except that a first slot 171A and two first fixed blocks 172 are straight to match the sidewall of a recess 91 of an top rail 90 (the recess 91 only opens on a bottom of the top rail 90). There are two flexible blocks 183 in the second preferred embodiment. It could achieve the same function.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. A cord lock of a window covering, comprising:

a box having a chamber therein, an engaging block integrally formed on a sidewall of the box, a first opening communicated with the chamber for a cord exiting the box, a second opening opposite the first opening for the cord entering the box, a fixed locking portion on an outer side of the box, and a flexible locking portion opposite the fixed locking portion;

a movable driving wheel, which is received in the chamber of the box, to be moved between a lock position, in which the movable driving wheel is moved toward the engaging block to clip the cord therebetween, and a release position, in which the movable driving wheel is moved away from the engaging block to release the cord; and a wear-resisted member provided on the engaging block to rest the cord thereon, wherein the engaging block further includes a convex portion having a curvature smaller than that of the movable driving wheel;

wherein the wear-resisted member is a plate made of a wear-resisting material, the wear-resisted member conforming completely to a shape of the engaging block such that an entire inner surface of the wear-resisting member engages the engaging block.

2. The cord lock of the window covering as claimed in claim 1, wherein the fixed locking portion includes two first fixed blocks and a first slot between the first fixed blocks, and the flexible locking portion includes a second fixed block, a flexible block, and a second slot between the second fixed block and flexible block, further wherein the flexible block has a hollow portion for allowing compression of the flexible block by an external pressure.

3. The cord lock of the window covering as claimed in claim 1, wherein the box has a first toothed portion on a sidewall of the chamber, and the movable driving wheel has a second toothed portion touching the first toothed portion, further wherein the second toothed portion is moved on the first toothed portion when the movable driving wheel is moved between the lock position and the release position.

4. The cord lock of the window covering as claimed in claim 1, wherein the box has a first curved portion and a second curved portion at opposite sides of the engaging block to support the cord when the cord does not pass the engaging block.

5. The cord lock of the window covering as claimed in claim 1, wherein the box further has a flexible locking portion.

6. The cord lock of the window covering as claimed in claim 1, wherein the fixed locking portion and the engaging block are on the same side of the box.

7. The cord lock of the window covering as claimed in claim 1, wherein the wear-resisted member engages the engaging block and the sidewall of the box.

8. The cord lock of the window covering as claimed in claim 1, further comprising a plurality of poles, wherein the box has a plurality of through holes on opposite sidewalls of the first opening, and the poles have opposite ends inserted into the through holes to divide first opening into several sub-openings.

9. The cord lock of the window covering as claimed in claim 8, wherein the poles are made of a wear-resisting hard material.

10. The cord lock of the window covering as claimed in claim 2, wherein the second fixed block is received in the second slot and proximal to the first opening, and the flexible block is received in the second slot and distal to the first opening.

11. The cord lock of the window covering as claimed in claim 2, wherein the first slot and the first fixed blocks are L-shaped members.

12. The cord lock of the window covering as claimed in claim 2, wherein the first slot and the first fixed blocks are straight members.

13. The cord lock of the window covering as claimed in claim 1, wherein the engaging block has two slots to engage the wear-resisted member, and a surface of the wear-resisted member where the cord leans thereon includes a first curved surface, a flat surface, a second curved surface, and a slope.

14. The cord lock of the window covering as claimed in claim 13, wherein the box has a first toothed portion on an inner side, and a self-lock angle is formed between the first toothed portion and the slope of the wear-resisted member to generate a self-lock action according to a wedge principle.

15. The cord lock of the window covering as claimed in claim 14, wherein the self-lock angle is between 32 degrees and 5 degrees.

* * * * *